US007121873B2

(12) United States Patent
Wu et al.

(10) Patent No.: US 7,121,873 B2
(45) Date of Patent: Oct. 17, 2006

(54) PLUG DETECTING DEVICE

(75) Inventors: Kuan-Heng Wu, Taoyuan (TW); Man-Wai Wong, Taoyuan (TW)

(73) Assignee: BenQ Corporation, Taoyuan (TW)

( * ) Notice: Subject to any disclaimer, the term of this patent is extended or adjusted under 35 U.S.C. 154(b) by 0 days.

(21) Appl. No.: 10/986,584

(22) Filed: Nov. 12, 2004

(65) Prior Publication Data

US 2005/0106930 A1 May 19, 2005

(30) Foreign Application Priority Data

Nov. 13, 2003 (TW) ..... 92131873 A

(51) Int. Cl.
*H01R 3/00* (2006.01)

(52) U.S. Cl. ..... 439/489; 439/188

(58) Field of Classification Search ..... 439/489 I, 439/490, 188

See application file for complete search history.

(56) References Cited

U.S. PATENT DOCUMENTS 6,241,550 B1 * 6/2001 Laity et al. ..... 439/490
6,290,533 B1 * 9/2001 Major ..... 439/490
6,483,712 B1 * 11/2002 Oliphant et al. ..... 361/737
6,554,484 B1 * 4/2003 Lampert et al. ..... 385/70
6,705,901 B1 * 3/2004 Lin ..... 439/668
6,905,363 B1 * 6/2005 Musolf et al. ..... 439/490
6,926,558 B1 * 8/2005 Sasai et al. ..... 439/620

* cited by examiner

*Primary Examiner*—Thanh-Tam Le
(74) *Attorney, Agent, or Firm*—Ladas & Parry LLP

(57) ABSTRACT

A plug detecting device comprises a circuit board, a signal processing unit, a connector, and a metal piece. The signal processing unit is installed on the circuit board. The connector is installed on the circuit board and electronically connected to the signal processing unit for connecting a plug having a metal outer ring with a first potential. The metal piece with a corresponding potential is electronically connected the signal processing unit and installed in the proximity of the connector. While the plug is plugged into the connector, the metal outer ring contacts the metal piece making the metal piece from the corresponding potential to the first potential, and that the signal processing unit confirms the plug has been plugged into the connector, so as to transmit or receive signals.

12 Claims, 7 Drawing Sheets

PLUG DETECTING DEVICE

BACKGROUND OF THE INVENTION

1. Field of the Invention

The present invention relates to a plug detecting device, especially to a plug detecting device installed on electronic products for detecting if a plug is plugged into a connector.

2. Description of the Prior Art

The plug detecting function is used for detecting if a plug of an electronic product is plugged into a connector. According to demand, some electronic products have to detect if the plug is plugged into the connector, so as to shunt the signals or remind the user that the plug is not plugged in yet.

According to the differences in standard or design, the connector comprises a plurality of pin holders with some functions, and the plug comprises the same number of pins with the same functions corresponding to the pin holders. The plug detecting method of the electronic products of the prior art is to detect the potential of one specific pin holders at fixed periods of time. Once the plug is plugged into the connector, the potential of the specific pin holder will change. The electronic product perceives the plug has been plugged into the connector and performs the corresponding function.

The plug detecting function of the prior art has to utilize a specific pin holder of a connector and the corresponding pin of a plug to perform detection. However, due to differences in standard and design, connectors of many standards may not provide the specific pin holder to perform detection. When each the pin holder has the specific function for transmitting signals respectively, there will be no extra pin holder to detect the plug. Therefore, the prior art cannot achieve the objective of detecting the plug via the present hardware.

Referring to FIG. 1, FIG. 1 is an external view of the plug 10 of the prior art. The standard of the plug 10 is S-Video (4-pole miniDIM), i.e. S-terminal, which is usually used to transmit signals between video/audio player and image output/input apparatus, e.g. communication of signals between DVD player or Digital Video Disc Player and TV. The plug 10 comprises four pins 11, 12, 13, 14, and each pin of the plug 10 is corresponding to a pin holder on the connector respectively. Moreover, the plug 10 comprises a metal outer ring 15. In this example, according to the standard of the plug 10, each pin and each the corresponding pin holder have different functions of signal communication respectively. Pin 11 is used for luminance return; pin 12 is used for chrominance return; pin 13 is used for luminance, and pin 14 is used for chrominance. The standard of the connector and the plug does not provide the needed pin holder and the corresponding pin for detecting the plug. If a designer wants to add the plug detecting function, he/she can only reset the signal communication protocol of the connector without increasing the number of pin holders, so as to obtain a pin holder for detecting the plug; otherwise, the designer can readjust the circuit of the connector and the plug to add a new pin holder and a corresponding pin for detecting the plug. The above-mentioned methods need to modify the communication manner, readjust the circuit, alter the hardware, or so on, so the cost of production is high, and the design is inconvenient.

SUMMARY OF THE INVENTION

The objective of the present invention is to provide a plug detecting device for electronic products to detect if the connector has connected to the corresponding plug, so as to selectively transmit and receive signals.

The present invention provides a plug detecting device comprising a circuit board, a signal processing unit, a connector, and a plug detecting element. The signal processing unit is installed on the circuit board. The connector is installed on the circuit board and electronically connected to the signal processing unit for connecting a plug having a metal outer ring with a first potential. The plug detecting element having a corresponding potential is electronically connected the signal processing unit and installed in the proximity of the connector. When the plug is plugged into the connector, the metal outer ring contacts the plug detecting element making the plug detecting element from the corresponding potential to the first potential, so the signal processing unit confirms the plug has been plugged into the connector, and starts to selectively transmit and receive signals.

The plug detecting device of the present invention enables the electronic products to detect the plug, without modifying the plug, the connector, and the circuit.

The advantage and spirit of the invention may be understood by the following recitations together with the appended drawings.

BRIEF DESCRIPTION OF THE APPENDED DRAWINGS

DETAILED DESCRIPTION OF THE INVENTION

The present invention provides a plug detecting device for detecting if the plug is plugged into the connector to selectively transmit and receive signals.

Figure 2:
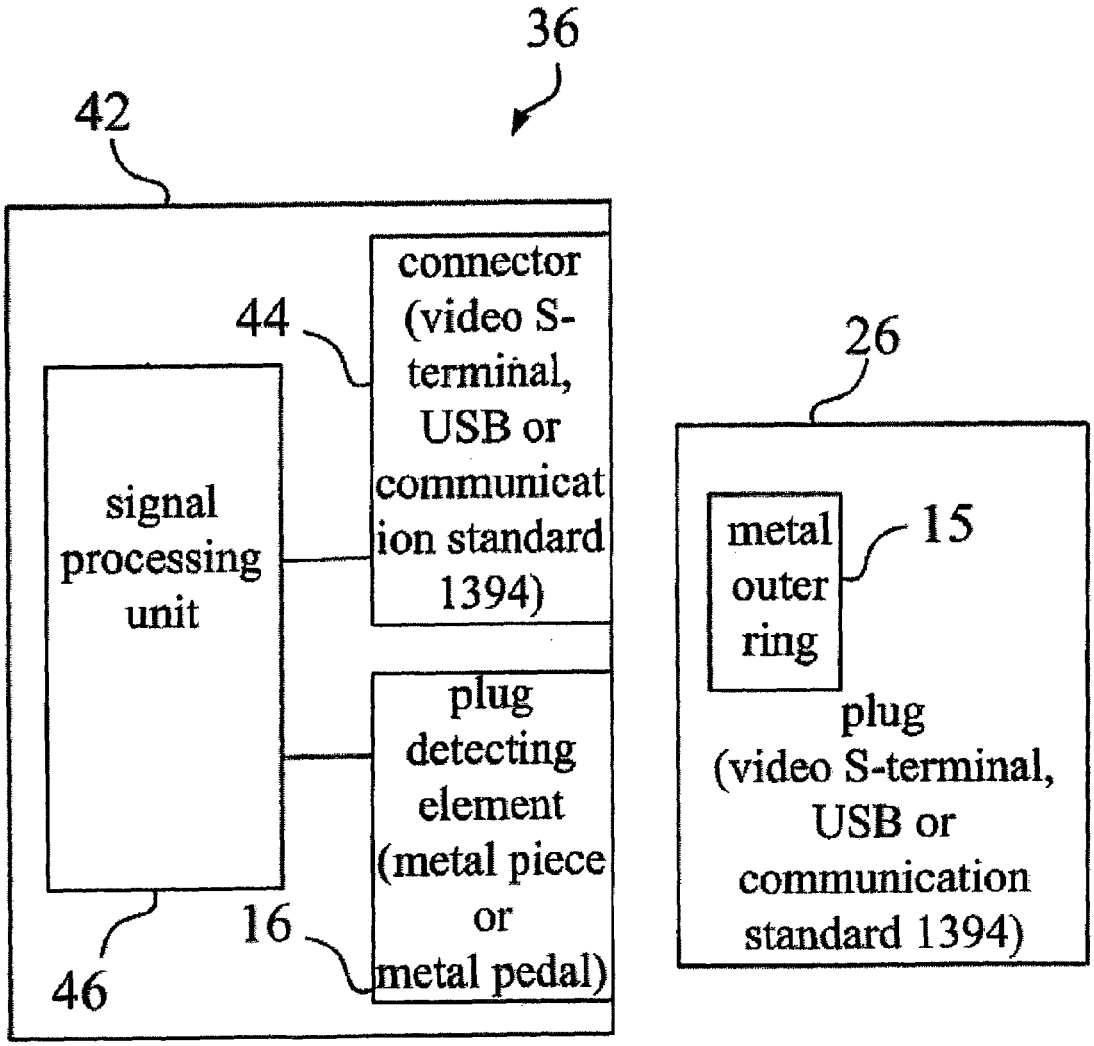
FIG. 2 is a functional block diagram of the plug detecting device of an embodiment according to the present invention.

Referring to FIG. 2, FIG. 2 is a functional bock diagram of the plug detecting device 36 of an embodiment according to the present invention. The plug detecting device 36 comprises a circuit board 42, a connector 44, a signal processing unit 46, and a plug detecting element 16 such as a metal piece. The circuit board 42 includes a front (i.e. first major surface) and a back (i.e. second major surface that is opposite the first major surface) The signal processing unit 46 and the connector 44 are installed on the front of the circuit board 42. The connector 44 is electronically connected to the signal processing unit 46 for connecting a plug 26 having a metal outer ring 15 with a first potential. The plug detecting element (the metal piece) 16 is a metal spring electronically connected the signal processing unit, and has a corresponding potential. The plug detecting element (the metal piece) 16 is installed on the back of the circuit board in the proximity of the connector 44. When the plug 26 is plugged into the connector 44, the metal outer ring 15 contacts the plug detecting element (the metal piece) 16, makes the plug detecting element from the corresponding potential to the first potential. Therefore, the signal processing unit 46 is noticed that the plug 26 has been plugged into the connector 44 by the potential change, and transmits or receives signals.

In another embodiment, the plug detecting element 16 may be a metal pedal installed on the front of the circuit board 42. The metal pedal is welded on the front of the circuit board 42. When the plug 26 is plugged into the connector 44, the metal outer ring 15 of the plug 26 contacts the metal pedal.

Figure 3:
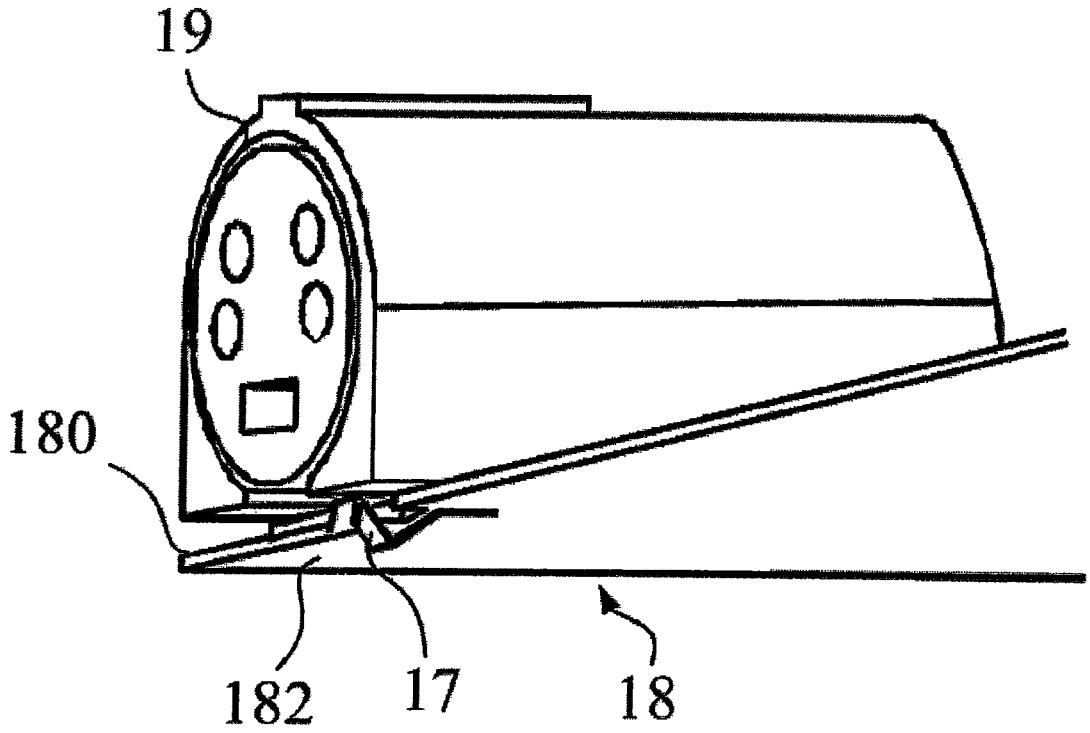
FIG. 3 is an external view of the plug detecting element according to the present invention.

Referring to FIG. 3, FIG. 3 is an external view of the plug detecting element according to the present invention. As shown in FIG. 3, the plug detecting element is a metal spring 17 installed on a circuit board 18 of an electronic product. The circuit board 18 further includes a front (i.e. first major surface 180) and a back. (i.e. second major surface 182 that is opposite the first major surface 180). The circuit board 18 comprises at least one signal processing unit (not shown) and has a connector 19. The signal processing unit and the connector 19 are installed on the first major surface 180 of the circuit board 18. The metal spring 17 is installed in the proximity of the connector 19, attached to the second major surface 182 circuit board 18, and electronically connected to the signal processing unit of the circuit board 18.

Figure 4:
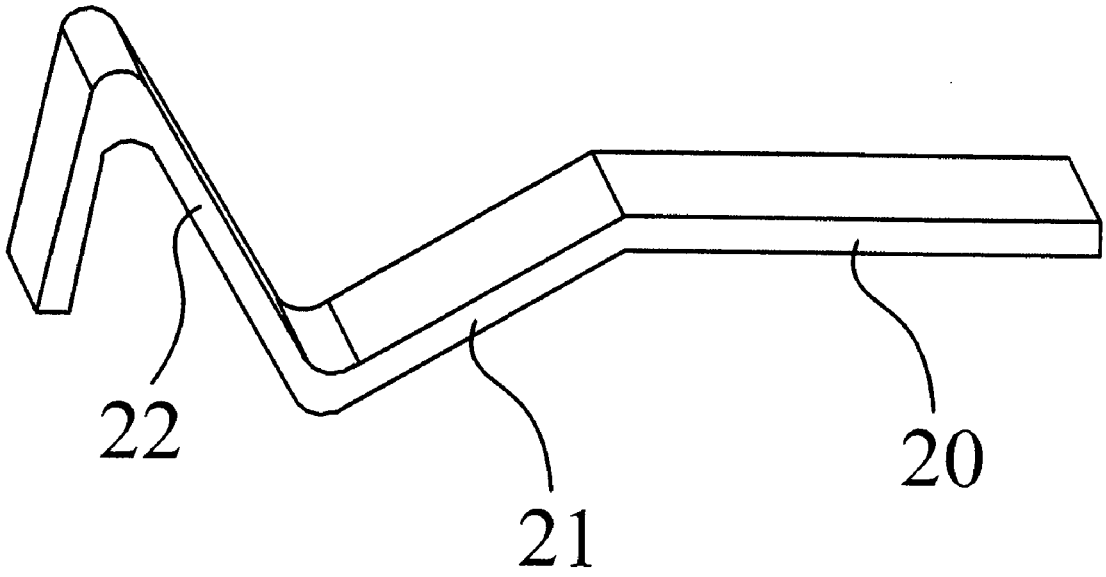
FIG. 4 is an external view of the metal spring shown in FIG. 3.

Referring to FIG. 4, FIG. 4 is an external view of the metal spring 17 shown in FIG. 3. The metal spring 17 includes a horizontally attaching portion 20, a downwardly extending portion 21, and an upwardly extending portion 22. As shown in FIG. 3, the horizontally attaching portion 20 of the metal spring 17 is welded on the second major surface 182 of the circuit board 18, and the metal spring 17 is not in contact with the circuit board 18 except through the horizontally attaching portion 20.

Figure 1:
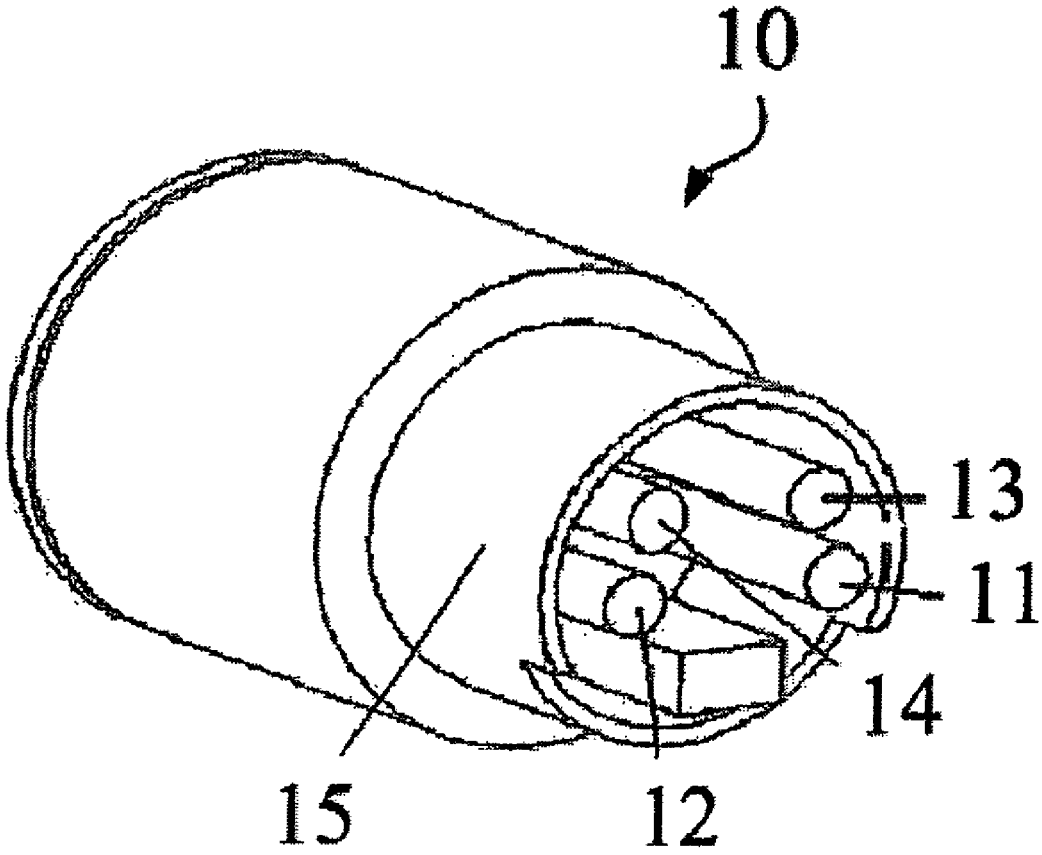
FIG. 1 (prior art)
FIG. 1 is an external view of the plug of the prior art.
Figure 5:
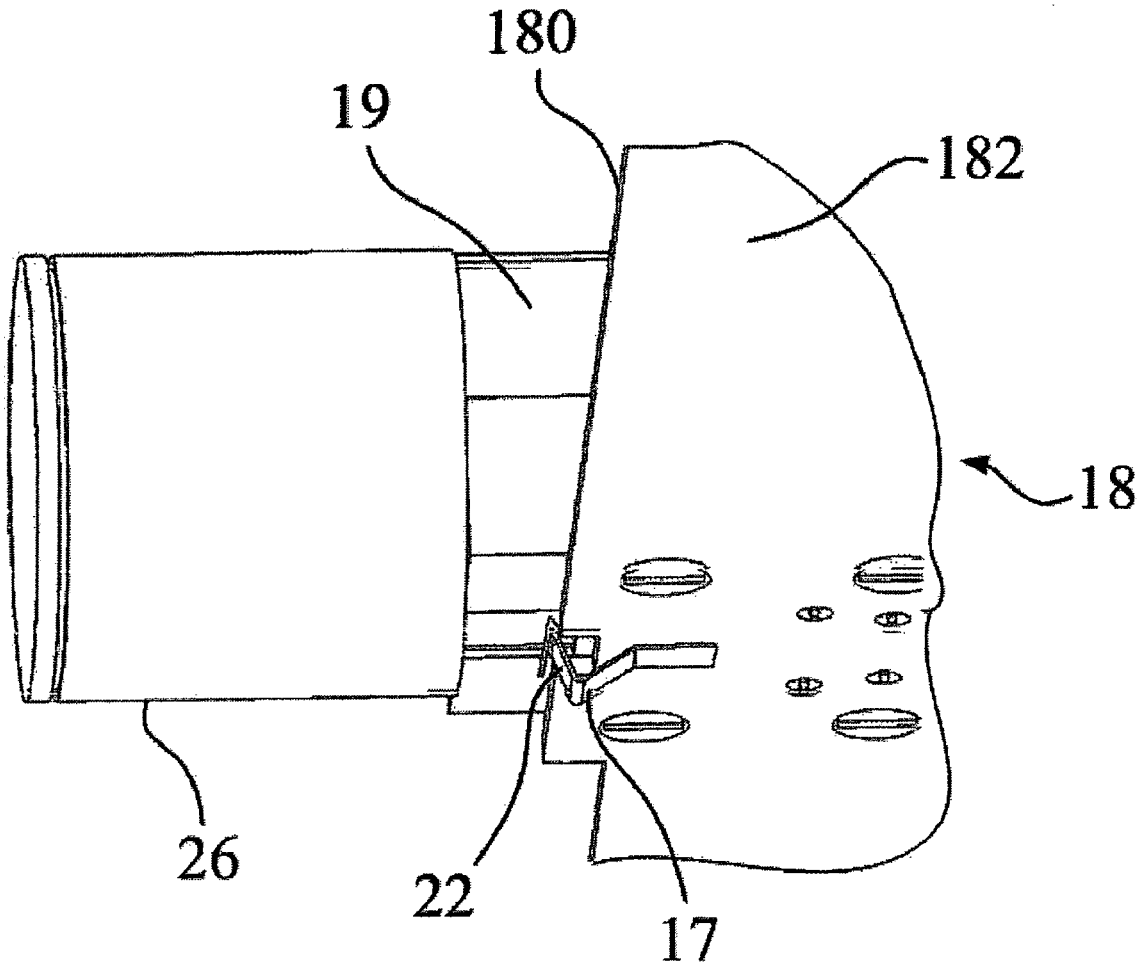
FIG. 5 is an external view of the plug plugged into the connector.

Referring to FIG. 5, FIG. 5 is an external view of the plug 26 plugged into the connector 19. The connector 19 can connect the plug 26 to transmit signals. Neither the plug 26 nor the connector 19 comprises the pin and the corresponding pin holder for detecting if the plug 26 is plugged into the connector 19. As shown in FIG. 5, when the plug 26 is plugged into the connector 19, the metal outer ring 15 shown in FIG. 1 contacts the upwardly extending portion 22 of the metal spring 17.

Figure 6:
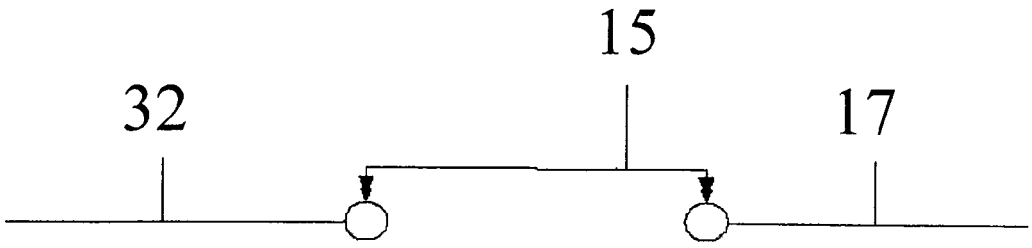
FIG. 6 is a circuit schematic diagram of the plug connecting to the connector shown in FIG. 5.
Figure 7:
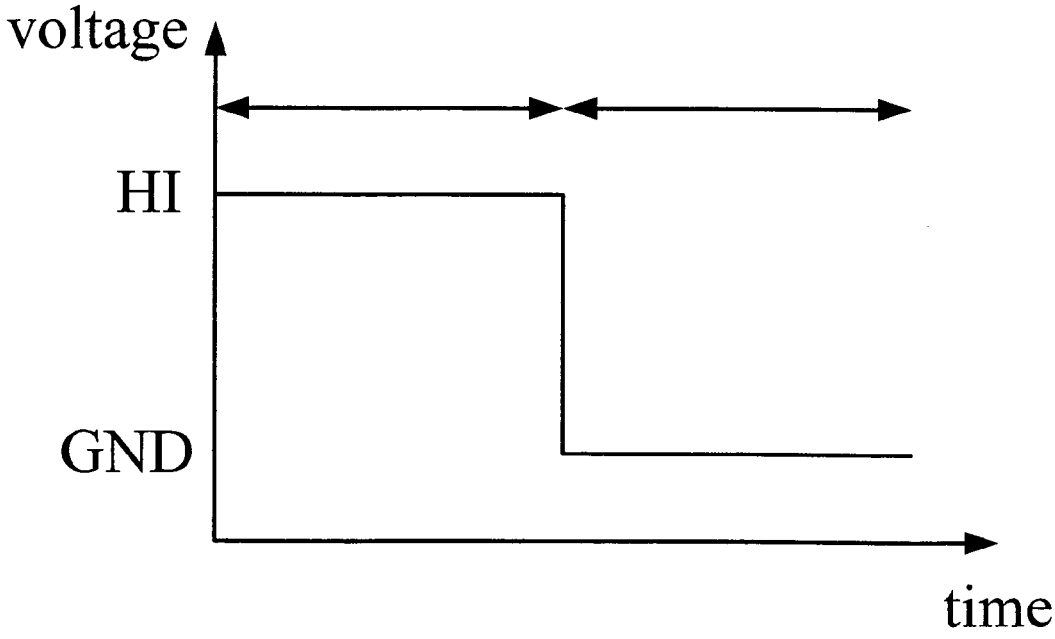
FIG. 7 is a voltage diagram before/after the plug connects to the connector shown in FIG. 5.

Referring to FIG. 6 and FIG. 7, FIG. 6 is a circuit schematic diagram of the plug 26 connecting the connector 19 shown in FIG. 5. FIG. 7 is a voltage diagram before/after the plug 26 connects the connector 19 shown in FIG. 5. When the plug 26 is plugged into the connector 19, the metal spring 17 is touched and conducted, so that the signal processing unit is noticed by the potential change of metal spring 17. As shown in FIG. 5, when the metal outer ring 15 with the grounded potential as the first potential contacts the upwardly extending portion 22, the metal outer ring 15 of the connector 26, the metal spring 17, and the grounded end 32 of the connector 19 will be conducted. The variation of voltage of the metal spring 17 before/after the plug 26 is plugged into the connector 19 is shown in FIG. 7. When the plug 26 has not been plugged into the connector 19 yet, the plug-in detecting signal, which is received from the metal spring 17 by the signal processing unit, is at a high potential (HI) voltage. When the plug 26 is plugged into the connector 19, the metal outer ring 15 with the grounded potential as the first potential contacts the upwardly extending portion 22, so that the potential of the voltage of the plug-in detecting signal is decreased (GND). The signal processing unit acknowledges the plug 26 has been plugged into the connector 19 according to the change of voltage of the plug-in detecting signal. When the plug 26 is plugged into the connector 19, the signal processing unit starts to transmit or receive signals for the connector 19. When the plug 26 has not been plugged into the connector 19 yet, the signal processing unit does not transmit signals to the connector 19, so as to maintain the purity of signals or save power.

Figure 8:
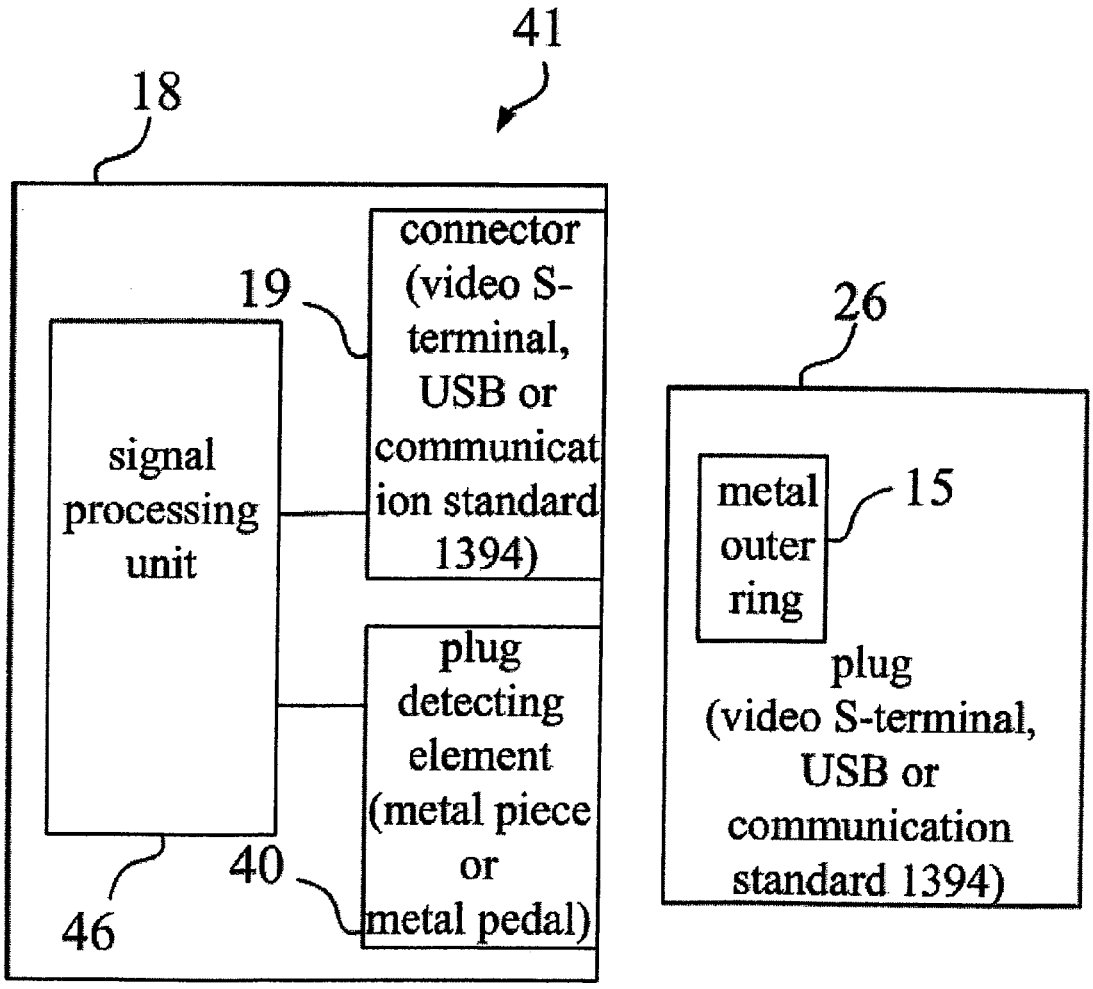
FIG. 8 is a functional block diagram of the plug detecting element according to the present invention.

Referring to FIG. 8, FIG. 8 is a functional block diagram of the plug detecting element 40 according to the present invention. As shown in FIG. 8, the plug detecting element 40 of the present invention is installed on an electronic product 41. The electronic product 41 comprises a circuit board 18, a signal processing unit 46, a connector 19 for connecting a plug 26, and a plug detecting element 40 located in the proximity of the connector 19. The plug 26 comprises a metal outer ring 15 with a first potential. The plug detecting element 40 may be a metal spring (not shown) or a metal pedal (not shown). The detailed functioning manner is similar with the above embodiment and will not be described in detail again.

The plug detecting element of the present invention can be applied to video S-terminal. The connector 19 may be a video S-terminal connector, and the plug 26 is correspondingly a video S-terminal plug. The connector may also be a universal serial bus (USB) connector, and the plug is correspondingly a USB plug. Furthermore, the connector may conform to a communication standard 1394, and the plug conforms to the communication standard 1394 correspondingly.

According to the present invention, the plug detecting device can overcome the disadvantage of no extra pin/pin holders in plug/connector for plug-detecting in the prior art. The present invention utilizes a plug detecting element such as a metal spring or a metal pedal to detect the plug, to improve the purity of signals, and to save power, all without modifying the specification of the plug or the connector and without readjusting the circuit.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A plug detecting device comprising:

a circuit board having a first major surface opposite a second major surface;

a signal processing unit disposed on the circuit board;

a connector disposed on the circuit board and electronically connected to the signal processing unit for connecting a plug having a metal outer ring with a first potential; and a plug detecting element having a corresponding potential electronically connected the signal processing unit;

wherein while the plug is plugged into the connector, the metal outer ring contacts the plug detecting element so that the corresponding potential changes to the first potential.

2. The plug detecting device of claim 1, wherein while the corresponding potential changes to the first potential, the signal processing unit starts to selectively transmit and receive signals.

3. The plug detecting device of claim 2, wherein the signal processing unit and the connector are disposed on the first major surface of the circuit board.

4. The plug detecting device of claim 3, wherein the first potential of the metal outer ring is grounded potential.

5. The plug detecting device of claim 4, wherein the plug detecting element is a metal pedal disposed on the first major surface of the circuit board.

6. The plug detecting device of claim 4, wherein the plug detecting element is a metal spring disposed on the second major surface of the circuit board.

7. The plug detecting device of claim 6, wherein the metal spring further includes a horizontally attaching portion, a downwardly extending portion, and an upwardly extending portion, the horizontally attaching portion of the metal spring is attached to the second major surface of the circuit board.

8. The plug detecting device of claim 7, wherein the horizontally attaching portion is welded on and in contact with the circuit board.

9. The plug detecting device of claim 7, wherein while the plug is plugged into the connector, the metal outer ring contacts the upwardly extending portion of the metal spring.

10. The plug detecting device of claim 1, wherein the connector is a video S-terminal connector, and the plug is correspondingly a video S-terminal plug.

11. The plug detecting device of claim 1, wherein the connector is a universal serial bus (USB) connector, and the plug is correspondingly a corresponding USB plug.

12. The plug detecting device of claim 1, wherein the connector conforms to a communication standard 1394, and the plug conforms to the communication standard 1394 correspondingly.

* * * * *